US005273950A

United States Patent [19]

Fukaya et al.

[11] Patent Number: 5,273,950

[45] Date of Patent: Dec. 28, 1993

[54] REVERSIBLE HEAT-SENSITIVE RECORDING MEDIUM

[75] Inventors: Kazuhiko Fukaya; Takashi Endou; Kensaku Higashi; Chikara Murata, all of Shizuoka, Japan

[73] Assignee: Tomoegawa Paper Co., Ltd., Tokyo, Japan

[21] Appl. No.: 43,961

[22] Filed: Apr. 14, 1993

[30] Foreign Application Priority Data

Apr. 20, 1992 [JP] Japan ..... 4-125437
Mar. 10, 1993 [JP] Japan ..... 5-075020

[51] Int. Cl.[5] ..... B41M 5/26

[52] U.S. Cl. ..... 503/208; 503/200; 503/201; 503/217; 503/225

[58] Field of Search ..... 503/200, 201, 208, 217, 503/225

[56] References Cited

U.S. PATENT DOCUMENTS 5,116,803 5/1992 Hotta et al. ..... 503/217

FOREIGN PATENT DOCUMENTS 55-154198 12/1980 Japan ..... 503/217
62-257883 11/1987 Japan ..... 503/217

*Primary Examiner*—Pamela R. Schwartz
*Attorney, Agent, or Firm*—Lowe, Price, LeBlanc & Becker

[57] ABSTRACT

The reversible heat-sensitive recording medium having a heat-sensitive recording layer capable of reversibly changing the transparency thereof with organic low molecular substances dispersed in an organic macromolecular resin provided on a support is characterized by using at least one long chain alkyl-containing compound having a melting point of 50°-100° C. and at least one saturated aliphatic bisamide having a melting point of not less than 110° C. as the organic low molecular substance in a ratio of 98:2 to 80:20. A plasticizer may be contained in the organic macromolecular resin in a ratio of 1 to 10% by weight, based on the total solid of the heat-sensitive recording layer.

5 Claims, 1 Drawing Sheet

REVERSIBLE HEAT-SENSITIVE RECORDING MEDIUM

BACKGROUND OF THE INVENTION

1. Field of the Invention

The present invention relates to a reversible heat-sensitive recording medium capable of reversibly recording and erasing an image by the application of heat.

2. Description of the Related Art

Japanese Patent early Publication Nos. 154198/1980 and 257883/1987 suggest reversible heat-sensitive recording media, according to which due to the difference of the temperatures upon heating, the transparency after being cooled can be reversibly changed, whereby images can be reversibly recorded thereon and erased therefrom. These recording media have a layered structure, including a layer, in which an organic low molecular substance such as a higher fatty acid is dispersed in an organic macromolecular resin such as a vinyl chloride-vinyl acetate copolymer in a fine particle form, as a heat-sensitive recording layer provided on a support.

The relation between the transparent state of these reversible recording media and the heat history given therefor is shown in FIG. 1. FIG. 1 is a constructional diagram showing the relation between the temperature of reversible heat-sensitive recording media and the transparency. The opaque (milky white state) portion can become transparent by heating it to a given temperature in the range of T1 to T2, and then gradually cooling it down to room temperature TR [(1)→(3)→(5)→(6)]. Conversely, in order to turn a transparent portion into an opaque state, the transparent portion may be heated to a temperature exceeding T3, and then gradually cooled down to room temperature [(6)→(5)→(4)→(2)→(1)]. In these cases, the transparent state or opaque state is stably maintained at room temperature TR as is.

In the conventional process, the range of the heating temperature, T1–T2, for an opaque portion becoming transparent (temperature range to achieve transparent state: TW) is very narrow and cannot be controlled in a desired range. Consequently, for a reversible heat-sensitive recording medium in an .opaque state becoming transparent, it is required to control the temperature strictly and, thus, the practical use of the conventional process entails great difficulty.

If a reversible heat-sensitive recording medium is heated for a sufficient duration of time by using a heating medium having a sufficient heat capacity, e.g., an oven or a heat block, in the case where the reversible heat-sensitive recording medium in an opaque state is to become transparent, the temperature range to achieve transparent state: TW (referred to as clarifying temperature" hereinafter) may not be so wide. However, if the heating media for the medium becoming opaque has an insufficient heat capacity, or if it cannot be heated for a sufficient period, e.g., in the case of the heat application by means of a thermal head or laser for a period of several milliseconds, then the clarifying temperature range TW should be set sufficiently broad, because a temperature gradient toward the thickness direction of the reversible heat-sensitive recording medium is caused upon being heated, resulting in the medium not being able to be heated to a uniform temperature. Nevertheless, the conventional reversible heat-sensitive media have a very wide range of the clarifying temperature, thus, it is difficult to use a thermal head, etc. as a heating medium for erasing images.

Yet, when a white opaque portion is erased to allow the media to become transparent by means of a heating medium which has an insufficient heat capacity or which cannot be heated over a sufficient period of time, the conventional reversible heat-sensitive media have the problem of not having sufficient erasing ability.

SUMMARY OF THE INVENTION

An object of the present invention is, therefore, to solve the problems of the prior art and to provide a reversible heat-sensitive recording medium having an extended clarifying temperature range TW, i.e., capable of controlling a temperature with ease and having good opaque-portion-erasing characteristics.

In one aspect of the present invention, there is thus provided a reversible heat-sensitive recording medium having a heat-sensitive recording layer capable of reversibly changing the transparency thereof with organic low molecular substances dispersed in an organic macromolecular resin provided on a support, at least one long chain alkyl-containing compound having a melting point of 50°–100° C. and at least one saturated aliphatic bisamide having a melting point of not less than 110° C. being used as the organic low molecular substance in a ratio of 98:2 to 80:20.

In another aspect of the present invention, there is provided a reversible heat-sensitive recording medium having a heat-sensitive recording layer capable of reversibly changing the transparency thereof with organic low molecular substances dispersed in an organic macromolecular resin provided on a support, at least one long chain alkyl-containing compound having a melting point of 50°–100° C. and at least one saturated aliphatic bisamide having a melting point of not less than 110° C. being used as the organic low molecular substance in a ratio of 98:2 to 80:20, and the heat-sensitive recording layer containing a plasticizer in a ratio of 1 to 10% based on the total solid content in the heat-sensitive recording layer.

DETAILED DESCRIPTION OF PREFERRED EMBODIMENTS

Figure 1:
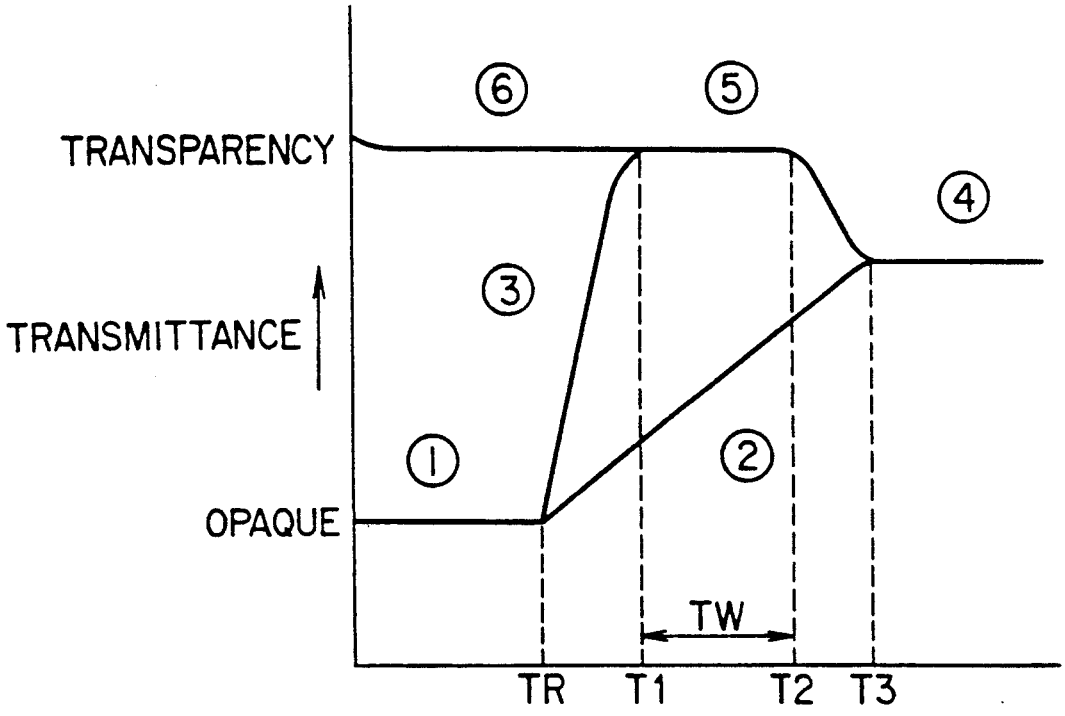
FIG. 1 is a constructional diagram showing the relation between the temperature of reversible heat-sensitive recording media and the transparency.

The construction of the reversible heat-sensitive recording medium according to the present invention will now be described.

The supports which can be used are those in which a color-coated layer is provided on a front or back surface of a synthetic resin film, the synthetic films with a color pigment kneaded therein. Also usable are transparent resin films, such as films made of polyvinyl chloride, polyester, polycarbonate, polyacetate, or polyimide, and those films having a reflective layer made of a metal layer provided thereon.

Preferable for use in the heat-sensitive recording medium as the organic macromolecular resin are those resins which have good transparency, excel in mechanical strength, and have good film-forming properties. Specific examples thereof include polyvinyl chloride, vinyl chloride-vinyl acetate copolymers, vinyl chloride-vinyl acetate-maleic acid terpolymers, vinyl chloride-vinyl acetate-vinyl alcohol terpolymer, vinyl acetateacrylate copolymers, vinylidene chloride-acrylonitrile copolymers, polyester resins, polyamide resins, acrylic resins, silicone resins, and the like.

The long chain alkyl-containing compound which is used as one of the organic low molecular substances is generally termed "wax", and indicates the substance which is a solid at room temperature. Any compound which contains a long chain alkyl group of approximately $C_{14}$-$C_{50}$ and has a melting point of 50° to 100° C. can be used, with an ester, amide, or ketone having a long alkyl chain being preferable. Specific examples include, but are not limited thereto, stearyl stearate, behenyl stearate, behenyl behenate, behenyl montanate, $C_{30}$-alcohol stearate, $C_{30}$-alcohol behenate, $C_{50}$-alcohol stearate, $C_{50}$-alcohol behenate, stearyl alcohol diester of eicosanedicarboxylic acid, etc. for the esters; palmitic acid amide, stearic acid amide, behenic acid amide, oleic acid amide, N-stearylstearic acid amide, N-oleylpalmitic acid amide, N-stearylerucic acid amide, N-stearyloleic acid amide etc. for the amides; and distearyl ketone, dibehenyl ketone, etc. for the ketones. These long alkyl chain-containing compounds may be used on their own or in combination with two or more compounds thereof.

The saturated aliphatic bisamides which can be used as the other organic low molecular substance are those which have a melting point of not less than 120° C., preferably in the range of 130° to 150° C., and include acid amides between a long chain saturated aliphatic acid and an alkylene diamine as well as between a saturated aliphatic dicarboxylic acid and a saturated aliphatic amine. Specific examples include, but are not limited to:

| | |
|---|---|
| Ethylene bis-(stearic acid) amide $(C_{17}H_{35}CONH)_2(CH_2)_2$ | m.p. 143° C. |
| Ethylene-bis(behenic acid) amide $(C_{21}H_{43}CONH)_2(CH_2)_2$ | m.p. 141° C. |
| Hexamethylene-bis(stearic acid) amide $(C_{17}H_{35}CONH)_2(CH_2)_6$ | m.p. 146° C. |
| Hexamethylene-bis(behenic acid) amide $(C_{21}H_{43}CONH)_2(CH_2)_6$ | m.p. 143° C. |
| N,N'-distearyladipic acid amide $(C_{18}H_{37}NHCO)_2(CH_2)_4$ | m.p. 144° C. |
| N,N'-distearyleicosanedicarboxylic acid amide $(C_{18}H_{37}NHCO)_2(CH_2)_8$ | m.p. 128° C. |
| N,N'-distearylsebacic acid $(C_{18}H_{37}NHCO)_2(CH_2)_8$ | m.p. 138° C |
| N,N'-dilauryldodecanedicarboxylic acid amide $(C_{12}H_{25}NHCO)_2(CH_2)_{10}$ | m.p. 138° C. |
| N,N-dilauryleicosanedicarboxylic acid amide $(C_{12}H_{25}NHCO)_2(CH_2)_{18}$ | m.p. 130° C. |
| N,N-distearyldodecanedicarboxylic acid amide $(C_{18}H_{37}NHCO)_2(CH_2)_{10}$ | m.p. 130° C. |

These saturated aliphatic bisamides may be used alone or as a mixture of two or more thereof.

In this case, if the saturated aliphatic bisamide has a melting point of less than 120° C., there arises the problem where no substantial enlargement of the clarifying temperature range can be obtained.

In the present invention, the weight ratio of the above-mentioned long chain alkyl-containing compound to the aliphatic bisamide should be within the range of 98:2 to 80:20. If the proportion of the aliphatic bisamide which occupies the organic low molecular substance is less than 2% by weight, there is no effect thereon upon the enlargement of the clarifying temperature range, while if it is higher than 20% by weight, no good contrast can be obtained.

For the formulation amounts of the organic low molecular substances dispersed in the organic macromolecular resin, the sum of the long chain alkyl-containing compound and the aliphatic bisamide is preferably in the range of 5 to 100 parts by weight, particularly 10 to 50 parts by weight, relative to 100 parts by weight of the organic macromolecular resin. If the total amount of the low molecular substances is less than 5 parts by weight, the heat-sensitive recording layer does not change into an opaque state sufficiently, resulting in no good contrast being obtainable. Conversely, if it is more than 100 parts by weight, the film-forming properties of the heat-sensitive recording layer change for the worse.

Any suitable plasticizer can be used as the plasticizer in the case of the incorporation of a plasticizer in the present invention. Specific examples are: phosphates, such as tributyl phosphate, tri-2-ethylhexyl phosphate, triphenyl phosphate, and tricresyl phosphate; phthalates, such as dimethyl phthalate, diethyl phthalate, dibutyl phthalate, di-n-octyl phthalate, diisooctyl phthalate, dicapryl phthalate, di-2-ethylhexyl phthalate, dioctyldecyl phthalate, diisodecyl phthalate, butyl benzyl phthalate, dibutoxy ethyl phthalate; monobasic fatty acid esters, such as butyl oleate, tetrahydrofurfuryl oleate, and glycerine monooleate; dibasic fatty acid esters, such as dibutyl adipate, di-n-hexyl adipate, di-n-ethylhexyl adipate, di-2-ethylbutyl azelate, di-2-ethylhexyl azelate, dibutyl sebasate, di-2-ethylhexyl sebacate, and dicapryl sebacate; dihydrylic alcohol esters, such diethylene glycol dibenzoate, triethylene glycol di-2-ethylbutyrate, and triethylene glycol di-2-ethylhexoate; oxyacid esters, such as methyl acetylricinolate, butyl acetylricinolate, methoxyethyl acetylricinolate, butylphthalyl butylglycolate, and tri(2-ethylhexyl) acetylcitrate; chlorinated paraffin; chlorinated biphenyl, 2-nitrobiphenyl; dinonylnaphthalene; camphor, methyl abitate, and the like. They can be used singly or used in any suitable combination of two or more of them.

It is desired for the amount of the plasticizer added to fall in the range of 1 to 10% based on the total solid concentration in the heat-sensitive layer. If the amount of the plasticizer added in less than the above-mentioned range, there is no effect brought about by the addition of the plasticizer, while if it is more than the above-mentioned range, the concentration of white lettering is decreased, thereby changing the contrast between the white lettering portion and the transparent skin for the worse.

The contrast can be enhanced if a light-reflective layer composed of a thin metal film such as one made of aluminum is provided between the heat-sensitive layer and the support. In such a case, the difference between the reflection densities (Macbeth densities) of the opaque portion and the transparent portion is preferably not less than 0.7. Taking these facts into consideration, the type and the amount of the plasticizer used can suitably be selected.

The heat-sensitive layer according to the present invention can be provided on a support by applying or printing on a support a solution of the organic macromolecular resin which may contain the plasticizer, the long chain alkyl-containing compound, and the saturated aliphatic bisamide; a dispersion of the organic macromolecular resin which may contain the plasticizer, the long chain alkyl-containing compound, and the saturated aliphatic bisamide; a mixture in which the organic macromolecular resin which may contain the plasticizer, the long chain alkyl-containing compound, and the saturated aliphatic bisamide are melted and mixed; or the long chain alkyl-containing compound, and the saturated aliphatic bisamide are dissolved in the organic macromolecular resin which may contain the plasticizer, followed by the film formation. In the formed heat-sensitive recording layer, the organic low molecular substances exist in the form of particles dispersed in the above-mentioned organic macromolecular resin, the particle size of the low molecular substances being distributed in the range of about 0.5 to 2 microns.

The thickness of the heat-sensitive recording layer is preferably in the range of 1 to 20 microns, more preferably in the range of 3 to 10 microns. If the thickness is less than 1 micron, the heat-sensitive recording layer insufficiently becomes opaque. If it is more than 20 microns, thermal transmission in the recording or erasing of letters with a thermal head becomes worse, which leads to bad sensitivity of the heat-sensitive recording layer to heat.

On the heat-sensitive recording medium of the present invention, the layers which will be described hereinbelow can be provided.

For example, when recording and erasing images are carried out using a thermal head, a protective layer comprising a thermoplastic or thermosetting resin, e.g., a polymethacrylate resin, a silicone resin, an acrylic resin, an alkyd resin, etc., or another resin, e.g., a photo-curing or electron beam-curing urethane-acrylate resin, etc., as a major ingredient may be provided on the heat-sensitive recording layer in order to improve the heat resistance of the heat-sensitive recording layer and to keep the compatibility with the thermal head.

For example, in order to prevent the migration of the organic low molecular substances contained in the heat-sensitive recording layer into other layers, or to enhance the adhesion between the heat-sensitive recording layer and the protective layer, an intermediate layer may be provided between the heat-sensitive recording layer and the protective layer.

Moreover, a magnetic recording layer may be provided either on the face of the support opposing the heat-sensitive recording layer, or between the support and the heat-sensitive recording layer.

In the case where a magnetic recording layer is provided on the face of the support opposing the heat-sensitive recording layer, in order to prevent the wearing of the magnetic recording layer, a protective layer comprising a thermoplastic or thermosetting resin, e.g., a polymethacrylate resin, a silicone resin, an acrylic resin, an alkyd resin, etc., or another resin, e.g., a photo-curing or electron beam-curing urethane-acrylate resin, etc., as a major ingredient may be provided on the magnetic recording layer.

The difference between the transparent state and the opaque state of the reversible heat-sensitive recording medium according to the present invention may be considered to be due to the difference of the crystalline states of the organic low molecular substances dispersed in the heat-sensitive recording layer.

To be specific, with regard to the transparent state, the following explanation can be made: The heat-sensitive recording layer in the reversible heat-sensitive recording medium is heated to a clarifying temperature T1–T2. At this time, the organic low molecular substances dispersed in the heat-sensitive recording layer are melted, but not completely. Subsequently, when the layer is allowed to cool, the un-melted organic low molecular substances serve as cores and large crystals grow therein in the course of cooling. Since the organic low molecular substances dispersed in the heat-sensitive recording layer exist as large crystals (single crystals), when a light is transmitted thereto, the degree of light-scattering on the interface thereof is small, whereby the heat-sensitive recording layer can be assumed to be in a transparent state.

For the opaque state, the following description can be made. The above-mentioned heat-sensitive recording layer is heated to a temperature of higher than TW. At this time, the organic low molecular substances dispersed in the heat-sensitive recording layer are completely melted. When the layer is allowed to cool, because of the absence of the core for crystal growth, crystals do not grow to a large size in the course of cooling, but become an assembly of fine microcrystals (polycrystals) after cooling. Consequently, a light transmitted in the heat-sensitive recording medium is scattered on the interfaces of microcrystals, whereby this layer can be assumed to be opaque.

Utilizing such a reversible change, the reversible heat-sensitive recording material of the present invention conducts recording and erasing images. According to the present invention, the clarifying temperature range can be extended.

The conventional reversible recording media have the problem in the fact that when the opaque lettered portion is erased by a heating medium having insufficient heat capacity, such as a thermal head or a heating means which cannot be heated for a sufficient period of time, the erasing ability is insufficient. This is considered to be due to the fact that the organic macromolecular resin in the heat-sensitive layer becomes hard with a elapse of time due to the rearrangement of the molecule, whereby the heat energy required for becoming transparent is increased to markedly decrease the sensitivity. In contrast, since a plasticizer is included in the case of the present invention, it may be considered that such a plasticizer plays a role in moderating the intermolecular force between the molecules of the organic macromolecular resin in the heat-sensitive recording layer to suppress the hardening of the organic macromolecular resin, thereby exhibiting an improvement in the characteristics of erasing the above-mentioned white opaque, in addition to the effect of extending the clarifying temperature range.

Since the long chain alkyl-containing compound having a melting point of 50°–100° C. and the saturated aliphatic bisamide having a melting point higher than that of the former compound are used as the organic low molecular substances in the heat-sensitive recording layer of the present invention, even when the temperature reaches the level of melting the long chain alkyl-containing compound upon heating the layer for becoming transparent, the saturated aliphatic bisamide remains unmelted in the heat-sensitive recording layer. The remaining saturated aliphatic bisamide serves as a core for crystals in the course of the crystallization. Consequently, the upper limit T2 of the clarifying temperature is shifted toward a higher temperature, resulting in the clarifying temperature range being extended.

According to the present invention, the clarifying temperature range is extended by using the long chain alkyl-containing compound and the saturated aliphatic bisamide having a melting point of not less than 110° C.

as the organic low molecular substance in a ratio of 98:2 to 80:20. As a result, a reversible heat-sensitive recording medium capable of easily erasing images even with a heat medium having a small heat capacity such as a thermal head can be provided.

EXAMPLES

The present invention will now be described by referring to the working examples. "Parts" means "parts by weight".

Example 1

A support was prepared by depositing aluminum on one face of a transparent polyethylene terephthalate film. The following coating for the heat-sensitive recording layer was applied to the face of the support opposing the aluminum deposited face by means of a wire bar, and dried to form a 100 micron thick heat-sensitive recording layer.

| Coating: | |
|---|---|
| Behenyl montanate | 95 parts |
| Ethylenebis(behenic acid) amide | 5 parts |
| Vinyl chloride-vinyl acetate copolymer | 300 parts |
| Tetrahydrofuran | 1600 parts |

Subsequently, the following coats were coated on the heat-sensitive recording layer, and dried to form a protective layer of 3 micron thickness, giving a reversible heat-sensitive recording medium according to the present invention.

| | |
|---|---|
| Silicone resin YR 3370 (produced by Toshiba Silicone Co., Ltd) | 400 parts |
| Catalyst CR15 (produced by Toshiba Silicone Co., Ltd) | 1 part |
| Isopropyl alcohol | 1600 parts |

Examples 2

A reversible heat-sensitive recording medium was obtained in the same manner as in Example 1, except that N,N'-distearyldodecanedicarboxylic acid amide was used in place of ethylene-bis(behenic acid).

Example 3

A reversible heat-sensitive recording medium was obtained in the same manner as in Example 1, except that N-stearyloleic acid amide was used in place of behenyl montanate.

Example 4

A reversible heat-sensitive recording medium was obtained in the same manner as in Example 1, except that distearylketone was used in place of behenyl montanate.

Example 5

A support was prepared by depositing aluminum on one face of a transparent polyethylene terephthalate film. The following coating for the heat-sensitive recording layer were applied to the face of the support opposing the aluminum deposited face by means of a wire bar, and dried to form a 100 micron thick heat-sensitive recording layer.

| Coating: | |
|---|---|
| Behenyl montanate | 95 parts |
| Ethylenebis(behenic acid) amide | 5 parts |
| Vinyl chloride-vinyl acetate copolymer | 300 parts |
| Di-2-ethylhexyl phthalate (plasticizer) | 20 parts |
| Tetrahydrofuran | 1600 parts |

Subsequently, the following coats were coated on the heat-sensitive recording layer, and dried to form a protective layer of 3 micron thickness, giving a reversible heat-sensitive recording medium according to the present invention.

| | |
|---|---|
| Silicone resin YR 3370 (produced by Toshiba Silicone Co., Ltd) | 400 parts |
| Catalyst CR15 (produced by Toshiba Silicone Co., Ltd) | 1 part |
| Isopropyl alcohol | 1600 parts |

Example 6

A reversible heat-sensitive recording medium was obtained in the same manner as in Example 5, except that 10 parts of dibutyl adipate were used in place of the plasticizer in Example 5.

Example 7

A reversible heat-sensitive recording medium was obtained in the same manner as in Example 5, except that 10 parts of diisodecyl phthalate were used in place of the plasticizer in Example 5.

Example 8

A reversible heat-sensitive recording medium was obtained in the same manner as in Example 5, except that 10 parts of di-2-ethylhexyl sebacate were used in place of the plasticizer in Example 5.

Example 9

A reversible heat-sensitive recording medium was obtained in the same manner as in Example 5, except that a mixture of 150 parts of vinyl chloride-vinyl acetate-vinyl alchol copolymer (SLEC-A: produced by Sekisui Chemical Co., Ltd.) and 150 parts of polyester resin (VYLON 290: produced by Toyobo Co., Ltd.) was used as an organic macromolecular resin in the heat-sensitive recording layer.

Comparative Example 1

A reversible heat-sensitive recording medium was obtained in the same manner as in Example 1, except that ethylene-bis(behenic acid) amide was omitted and behenyl montanate was changed in an amount of 100 parts.

Comparative Example 2

A reversible heat-sensitive recording medium was obtained in the same manner as in Example 1, except that ethylenebis(behenic acid) amide and behenyl montanate were omitted and N-stearyloleic acid amide was changed in an amount of 100 parts.

Comparative Example 3

A reversible heat-sensitive recording medium was obtained in the same manner as in Example 1, except that ethylenebis(behenic acid) amide and behenyl montanate were omitted and distearylketone was changed in an amount of 100 parts.

Comparative Example 4

A reversible heat-sensitive recording medium was obtained in the same manner as in Example 5, except that the plasticizer used in Example 5 was changed in an amount of 80 parts.

The samples of reversible heat-sensitive recording media produced as described above were thoroughly heated in an oven at 130° C., the whole surface becoming completely white opaque. Thereafter, a heat block was applied on each of the samples at a pressure of 400 g/m$^2$ for 1 second using a heat gradient tester produced by Toyo Seiki Co., Ltd. to carry out recording and erasing tests. When a heat block at which the temperature reached a temperature for allowing the substance to become transparent was applied, the portion which was applied became transparent. This was used to determine the clarifying temperature range. Also, using each of the reversible heat-sensitive recording media, the white opaque portion thereof became transparent by an 8/mm thin type heat-sensitive head to evaluate the erasing characteristics. The results are shown in Table 1. The evaluation of the erasing characteristics was carried out by completely turning the entire surface of the reversible heat-sensitive recording media into a transparent state in an oven, carrying out white opaque solid printing, and then turning into a transparent state using the heat-sensitive head at which the maximum white opaque lettering density was reached. As a measure of the erasing characteristics, the ratio of erasing (R) was calculated from the following equation:

$$R=(B-C)/(A-C)\times 100(\%)$$

wherein A, B, and C were the following reflection densities measured by a Macbeth reflection densitometer (RD-914):

A: the transparent skin density (the reflection density at which the entire surface becomes transparent in an oven)

B: the transparent density (the reflection density at a portion becoming transparent using a heat-sensitive head)

C: the maximum white opaque lettering density

The criteria are as follows:

○ . . . 80%R; Δ . . . 70%<R<80%; × . . . 70%>R

In Comparative Example 1, the difference (contrast) between the maximum white opaque lettering density and the transparent skin was, however, small and, thus, the image characteristics were too bad to evaluate the rate of erasing (R). For this reason, the criterion was not assumed to be practically applicable, and the rating of x was made without any real evaluation.

The clarifying temperature ranges: TW measured as described above are shown in Table 1.

TABLE 1

| Ex. | TW (°C.) | Clarifying Temperature (°C.) | Erasing Characteristics A | B | C | R (%) | Rating |
|---|---|---|---|---|---|---|---|
| 1 | 30.0 | 77.5–107.5 | 1.50 | 1.32 | 0.40 | 84.5 | ○ |
| 2 | 32.5 | 77.5–110.0 | 1.52 | 1.34 | 0.38 | 84.2 | ○ |
| 3 | 25.0 | 67.5–92.5 | 1.52 | 1.31 | 0.42 | 80.9 | ○ |
| 4 | 28.0 | 72.5–100.5 | 1.53 | 1.34 | 0.39 | 83.3 | ○ |
| 5 | 35.0 | 72.5–107.5 | 1.60 | 1.50 | 0.70 | 88.9 | ○ |
| 6 | 35.0 | 72.5–107.5 | 1.62 | 1.55 | 0.80 | 91.5 | ○ |
| 7 | 30.0 | 65.0–95.0 | 1.65 | 1.45 | 0.58 | 81.3 | ○ |
| 8 | 30.0 | 68.0–98.0 | 1.55 | 1.40 | 0.55 | 85.0 | Δ |
| 9 | 32.0 | 70.5–102.5 | 1.30 | 1.27 | 0.65 | 95.4 | ○ |
| Com. 1 | 3.0 | 80.0–83.0 | 1.50 | 0.50 | 0.38 | 10.7 | X |
| Com. 2 | 2.5 | 67.5–70.0 | 1.50 | 0.40 | 0.35 | 4.4 | X |
| Com. 3 | 4.0 | 77.5–81.5 | 1.52 | 0.56 | 0.38 | 15.8 | X |
| Com. 4 | 35.0 | 70.0–105.0 | 1.65 | — | 1.14 | — | X |

As is clear from the results of Table 1, the samples of the present invention to which a saturated aliphatic bisamide was added had significantly extended clarifying temperature range in comparison with the samples of Comparative Examples 1 to 3, which added no such compound, and could be confirmed to have an enhanced erasing rate. Examples 5 to 9 made it clear that the clarifying temperature range and the erasing rate can be further improved by the addition of a plasticizer. It can be confirmed from Comparative Example 4 that the amount of the plasticizer formulated has a great influence on the contrast (visuality) between the maximum white opaque lettering density and the transparent skin.

What is claimed is:

1. A reversible heat-sensitive recording medium having a heat-sensitive recording layer capable of reversibly changing the transparency thereof with organic low molecular substances dispersed in an organic macromolecular resin provided on a support, at least one long chain alkyl-containing compound having a melting point of 50°–100° C. and at least one saturated aliphatic bisamide having a melting point of not less than 110° C. being used as the organic low molecular substance in a ratio of 98:2 to 80:20.

2. The reversible heat-sensitive recording medium as claimed in claim 1, wherein the macromolecular resin contains a plasticizer in a ratio of 1 to 10% by weight, based on the total solid of the heat-sensitive recording layer.

3. The reversible heat-sensitive recording medium as claimed in claim 1, wherein an ester formed from a higher fatty acid and a higher alcohol is used as said long chain alkyl-containing compound.

4. The reversible heat-sensitive recording medium as claimed in claim 1, wherein a higher aliphatic amide formed from a long chain saturated aliphatic acid and a alkaline diamine is used as said saturated aliphatic bisamide and a wax, ester, amide or ketone is used as said long chain alkyl-containing compound.

5. The reversible heat-sensitive recording medium as claimed in claim 1, wherein said saturated aliphatic bisamide has a melting point of 130° to 150° C.

* * * * *